US007946734B2

(12) United States Patent
Laporte

(10) Patent No.: US 7,946,734 B2
(45) Date of Patent: May 24, 2011

(54) LOW UP-LIGHT CUTOFF ACORN STYLE LUMINAIRE

(75) Inventor: Jean-Francois Laporte, Boisbriand (CA)

(73) Assignee: Philips Electronics LTD, Markham, ON (CA)

( * ) Notice: Subject to any disclaimer, the term of this patent is extended or adjusted under 35 U.S.C. 154(b) by 304 days.

(21) Appl. No.: 12/037,373

(22) Filed: Feb. 26, 2008

(65) Prior Publication Data

US 2008/0232111 A1 Sep. 25, 2008

Related U.S. Application Data

(60) Provisional application No. 60/892,127, filed on Feb. 28, 2007.

(51) Int. Cl.
*F21V 7/00* (2006.01)

(52) U.S. Cl. ..... 362/308; 362/309; 362/328; 362/363

(58) Field of Classification Search ..... 362/308–309, 362/328, 363

See application file for complete search history.

(56) References Cited

U.S. PATENT DOCUMENTS

| | | | |
|---|---|---|---|
| 463,337 | A | 11/1891 | Porteous |
| 1,204,801 | A | 11/1916 | McArthur |
| 1,243,481 | A | 10/1917 | Beard |
| 1,246,728 | A | 11/1917 | Downey |
| 1,247,000 | A | 11/1917 | Plaut |
| 1,299,936 | A | 4/1919 | Harrison |
| 1,371,761 | A | 3/1921 | Halvorson, Jr. |
| 1,659,325 | A | 6/1923 | Dorey |
| 1,480,189 | A | 1/1924 | Walsh et al. |
| 1,612,856 | A | 1/1927 | Doane |
| 1,633,837 | A | 6/1927 | Youtz |
| 1,644,452 | A | 10/1927 | Spencer |
| 1,681,151 | A | 8/1928 | Dailey, Jr. |
| 1,701,176 | A | 2/1929 | Doane |
| 1,702,746 | A | 2/1929 | Prichard |
| 1,774,452 | A | 8/1930 | O'Neil |
| 1,900,330 | A | 3/1933 | Chartrand |
| 1,900,436 | A | 3/1933 | Dourgnon |
| 1,913,377 | A | 6/1933 | Dorey |
| 1,941,503 | A | 1/1934 | Villiers |
| 1,953,816 | A | 4/1934 | Naysmith |
| 1,969,714 | A | 8/1934 | Burger |
| 2,021,611 | A | 11/1935 | Rolph |
| 2,133,377 | A | 10/1938 | Cullman |
| 2,133,378 | A | 10/1938 | Cullman |
| 2,166,394 | A | 7/1939 | Crossley |
| 2,170,912 | A | 8/1939 | Rolph |
| 2,198,077 | A | 4/1940 | Curtis |
| 2,905,808 | A | 9/1959 | Wince |
| 3,055,535 | A | 9/1962 | Schneider |
| 3,251,987 | A | 5/1966 | Wince |
| 3,340,393 | A | 9/1967 | Frank et al. |
| 3,388,246 | A | 6/1968 | Bailey |

(Continued)

*Primary Examiner* — Stephen F Husar
*Assistant Examiner* — Meghan K Dunwiddie
(74) *Attorney, Agent, or Firm* — John F. Salazar; Mark L. Beloborodov

(57) ABSTRACT

A low upright cutoff classification acorn style luminaire is described. The acorn style luminaire has a globe which has a top positioned thereon and which is mounted to a pole. Integrated within the luminaire is the lamp support and lamp, the lamp substantially surrounded and enclosed by a reflector. The interior surface of the globe has a plurality of substantially vertically extending prisms along a curved surface thereof, the prisms working in conjunction with the reflector to provide cutoff classification for the acorn style luminaire.

12 Claims, 6 Drawing Sheets

U.S. PATENT DOCUMENTS 3,413,462 A 11/1968 Spero
3,448,260 A 6/1969 Wince et al.
3,505,515 A 4/1970 Adra
3,604,916 A 9/1971 Adra
3,646,338 A 2/1972 Goytisolo
3,679,889 A 7/1972 Franck
3,748,465 A 7/1973 Murray et al.
3,790,774 A 2/1974 Miller et al.
4,090,210 A 5/1978 Wehling et al.
4,143,413 A 3/1979 Kelly
4,164,010 A 8/1979 Finch
4,188,657 A 2/1980 Reibling
4,212,050 A 7/1980 Trenkler
4,229,782 A 10/1980 Ruud et al.
4,242,725 A 12/1980 Douma et al.
4,261,028 A 4/1981 Adam
4,261,030 A 4/1981 Hernandez
4,293,901 A 10/1981 Hernandez
4,310,876 A 1/1982 Small, Jr. et al.
4,319,313 A 3/1982 Eberhart et al.
4,333,131 A 6/1982 Hujimoto et al.
4,360,863 A 11/1982 Barnes et al.
4,390,934 A 6/1983 Willing
4,410,931 A 10/1983 DeCandia et al.
4,451,875 A 5/1984 Odie et al.
4,462,068 A 7/1984 Shadwick
4,471,411 A 9/1984 Graham et al.
4,473,873 A 9/1984 Quiogue
4,516,196 A 5/1985 Blake
4,527,224 A 7/1985 Sangiamo et al.
4,531,180 A 7/1985 Hernandez
4,559,587 A 12/1985 Quiogue et al.
4,564,888 A 1/1986 Lewin et al.
4,569,003 A 2/1986 Elmer et al.
4,587,602 A 5/1986 Dean et al.
4,590,544 A 5/1986 Decandia
4,623,956 A 11/1986 Conti
4,719,548 A * 1/1988 Orosz ..... 362/309
4,731,714 A 3/1988 Kelly et al.
4,760,511 A 7/1988 Russello et al.
4,851,970 A 7/1989 Bronder
4,858,091 A 8/1989 Fouke
4,862,333 A 8/1989 Brasket
4,881,156 A 11/1989 Shemitz et al.
4,894,758 A 1/1990 O'Toole
4,937,718 A 6/1990 Murray
5,051,878 A 9/1991 Ngai
5,068,769 A 11/1991 Umeda et al.
5,158,348 A 10/1992 Sakamoto et al.
5,278,745 A 1/1994 Kelly et al.
5,289,358 A 2/1994 Halemeier
5,307,254 A 4/1994 Russello et al.
5,309,341 A 5/1994 Russello et al.
5,313,379 A 5/1994 Lemons et al.
5,339,234 A 8/1994 Russello et al.
5,363,293 A 11/1994 Lasker
5,379,199 A 1/1995 Hirshenhorn et al.
5,383,102 A 1/1995 Jones
D364,242 S 11/1995 Fiorato
5,546,292 A 8/1996 Shemitz
5,586,015 A 12/1996 Baldwin et al.
5,613,766 A 3/1997 Rauof
5,615,947 A 4/1997 Shambo et al.
5,642,934 A 7/1997 Haddad
5,647,659 A 7/1997 Mori
5,707,142 A 1/1998 Gordin
5,743,634 A * 4/1998 Sitzema et al. ..... 362/341
5,803,585 A 9/1998 Littman et al.
5,906,431 A 5/1999 Chianale et al.
5,938,317 A 8/1999 Thornton
5,997,156 A 12/1999 Perlo et al.
5,997,158 A 12/1999 Fischer et al.
6,027,231 A 2/2000 Fouke
6,059,422 A 5/2000 Fischer et al.
6,234,643 B1 5/2001 Lichon, Jr.
6,238,065 B1 5/2001 Jones
6,260,981 B1 7/2001 Fiene
6,290,376 B1 9/2001 Gutierrez et al.
6,523,982 B1 2/2003 Haddad
6,703,799 B2 3/2004 Summerford et al.
6,945,675 B2 9/2005 Jongewaard et al.
6,971,772 B1 * 12/2005 Abdelsamed et al. ..... 362/309
7,244,050 B2 7/2007 Summerford et al.
7,296,914 B1 11/2007 Russello et al.
2005/0281034 A1 12/2005 Summerford et al.

* cited by examiner

LOW UP-LIGHT CUTOFF ACORN STYLE LUMINAIRE

CROSS-REFERENCE TO RELATED APPLICATION

This application, under 35 USC §119(e), claims priority to, and benefit from, U.S. Provisional Application Ser. No. 60/892,127, filed on Feb. 28, 2007, entitled "Low Up-Light Cutoff Acorn Style Luminaire," naming the above-listed individual as the sole inventor.

FIELD OF THE INVENTION

The present invention is related to outdoor luminaires and in particular to outdoor lighting fixtures or street lighting wherein the luminaire optical system is designed so as to provide a low up-light cutoff distribution through the use of various reflective and refractive properties of the globe and reflectors.

BACKGROUND OF THE INVENTION

Outdoor luminaires and street lighting in particular are commonly required to meet dark sky regulations and/or cutoff classifications for their light output, distribution and up-light contribution. Typical cutoff distributions, as defined by known illumination standards, are designated as having less than 25 candelas per 1,000 lamp lumens emitted at angles 90 degrees and above and less than 10 percent or 100 candelas per 1,000 lamp lumens emitted at or above angles 80 degrees from nadir. Such cutoff distributions require up-light contributions of less than 2½ percent of the luminaires lumen output. Cutoff and semi-cutoff designations for exterior luminaires and street lighting are accomplished through various known techniques including utilizing exterior hoods or prismatic combinations in order to redirect light. Further, traditional shaped acorn luminaires have typically been fabricated from full prismatic globes or textured surface globes. These various types of known globes produce a significant amount of up-light, possibly as much as 30 percent of the luminaires lumen output due to reflection on these surfaces. Up-light shields, as mentioned, are known to be added to exterior portions of the acorn luminaires in order to create cutoff type designation or distribution. However, utilizing such techniques greatly reduces the luminaire efficiency while still providing 6 percent or more of up-light. Many of these known techniques include utilization of full prismatic globes which incorporate horizontally extending prismatic surfaces in order to reflect and refract the light in the desired distribution. These full prismatic globes typically utilize prisms disposed on exterior surfaces of the reflector section and refractive prisms disposed on the exterior or interior surfaces in combination in order to redirect light through a focal point interior of the globe. Further, designs include utilization of multiple refractive zones which act in combination to selectively vary light distribution characteristics of vertical and lateral angles and intensities. Most of these prior art systems however, rely upon the utilization of these external structures such as prismatic surfaces and the like on the globe or reflector/refractor as it is typically very difficult to implement utilization of a cutoff classification acorn style luminaire utilizing only internal optics and systems. Many times these difficulties are overcome in prior art systems through the utilization of reflector or refractor systems in combination with shrouds which overly enclose the lamp and provide significant additional reflective surfaces on the globe.

These issues indicated above are even more difficult to overcome in a acorn globe style luminaire wherein cutoff classification through the use of internal optics successfully produces a cutoff distribution with up-light contributions desired to meet proper cutoff classification criteria. This is particularly the case in acorn style luminaire designs where the bottom portion of the globe is blocked by the top of the mounting pole and support base for the luminaire itself and not an open bottom such as is found in open ended reflector/refractors. Thus, for low up-light classification acorn style luminaires to meet proper cutoff criteria, light must be angled within a band extending below 90 degrees horizontal to an area directly around the lamp support base and lamp post.

Such a design requirement is met by providing in one of the present embodiments a low up-light cutoff classification acorn style luminaire having a semi-prismatic globe enclosing a space and mounted on the top of a mounting pole, the semi-prismatic globe having an open aperture at a lower end, the open aperture at the lower end having a mounting collar mounted in between the globe and the mounting pole, the mounting collar supporting a lamp within the enclosed space, the semi-prismatic globe having a plurality of substantially vertically extending prisms on an interior surface thereof and having a substantially smooth exterior, the lamp positioned within the enclosed space and substantially surrounded by a reflector, the reflector enclosing the lamp in order to shield all the direct light contributions from the lamp being emitted at angles above 90 degrees from nadir, wherein the plurality of substantially vertical prisms extend from the lower edge of the globe upward towards a substantially vertical section of the globe along a curved section of the globe.

Furthermore, one embodiment of the present invention includes a low up-light cutoff semi-prismatic acorn style luminaire having a semi-prismatic globe defining an interior space, a reflector retained within the interior space and substantially enclosing and surrounding a lamp, the arc lamp having a center point, the center point of the lamp positioned within said reflector, the reflector having a supporting bracket for supporting the reflector within the globe wherein the reflector encloses the lamp and shields all direct contributions of light emitted by the lamp at angles above 90 degrees from nadir, the globe free from prismatic structures on an exterior surface, the globe having a substantially vertical section and a curved section, wherein the curved section has a plurality of substantially vertically extending prisms interspaced on an interior wall, the plurality of prisms positioned in order to minimize the reflected light from the lamp and to redirect the reflected light by reflecting it below 90 degrees from nadir, the curved section of the globe mounted to a mounting collar for mounting of the globe onto a mounting pole, the lamp mounted within the globe and interior of said reflector by a lamp support mechanism in order to properly position the lamp within the reflector.

DETAILED DESCRIPTION OF THE PREFERRED EMBODIMENT

Figure 1:
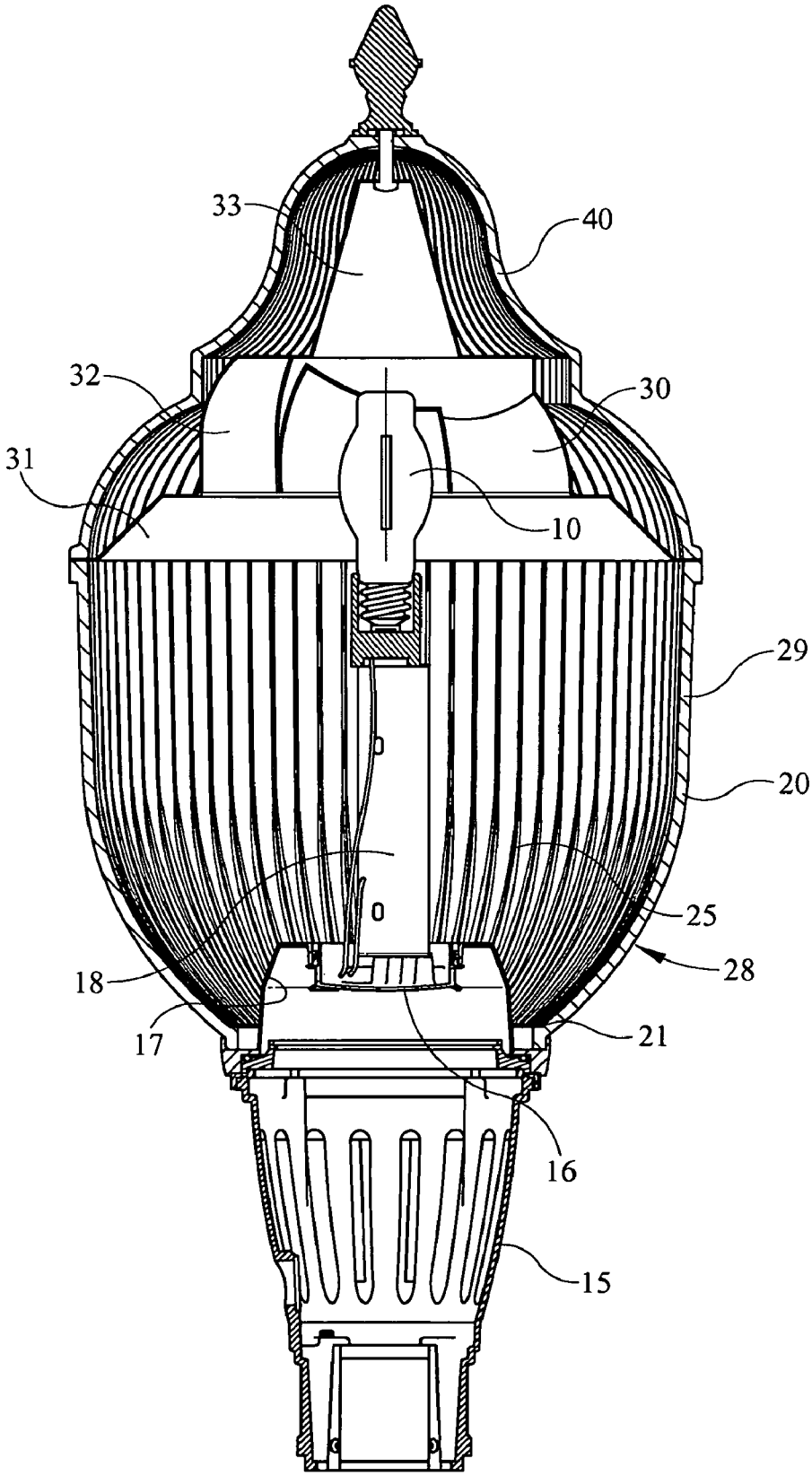
FIG. 1 is a side-sectional view of the low up-light cutoff acorn luminaire of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Acorn style luminaires due to their inherent curvature and design have proven to be problematic from a reflection characteristic standpoint in creating a true cutoff classification acorn style luminaire. This is particularly the case since the lower portion of the acorn style luminaire globe tends to refract or reflect light above 90 degrees due to the characteristics of the globe material and due to the curvature of the globe at the lower end thereof. Additionally, due to the inherent properties and designs of acorn style luminaires, the amount of area of the globe which may reflect or refract light above 90 degrees is significant as a result of the lower portion of the globe being connected to the lamp post in most acorn style designs. Thus, a high concentration of light rays are directed towards a central to lower central portion of the globe and particularly to a curved lower portion of the globe, the curvature of the globe scattering light in multiple directions and possibly redirecting or reflecting light upwards above 90 degrees form horizontal. Such reflection or refraction of light above 90 degrees from horizontal can prove to be problematic in the design of cutoff classification acorn style luminaires. By cutoff classification and distribution, it is desirable although not necessarily required, to have less than 25 candelas per 1,000 lamp lumens emitted at or above angles 90 degrees and above and less than 100 candelas per 1,000 lamp lumens emitted at angles 80 degrees from nadir. It may also be desirable to have up-light contributions of less than 2½ percent of the luminaire lumen output, the up-light measured by the percentage of total luminaire flux output directed at angles above 90 degrees from nadir.

Figure 4:
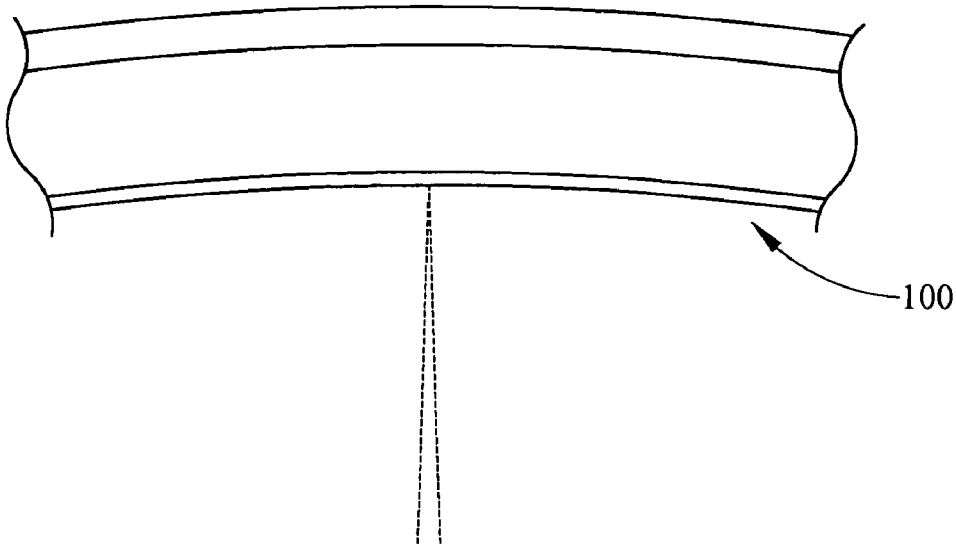
FIG. 4 is a top-sectional view of a clear globe without transmitting prisms and indicating the effect on such globe of reflective light.
Figure 5:
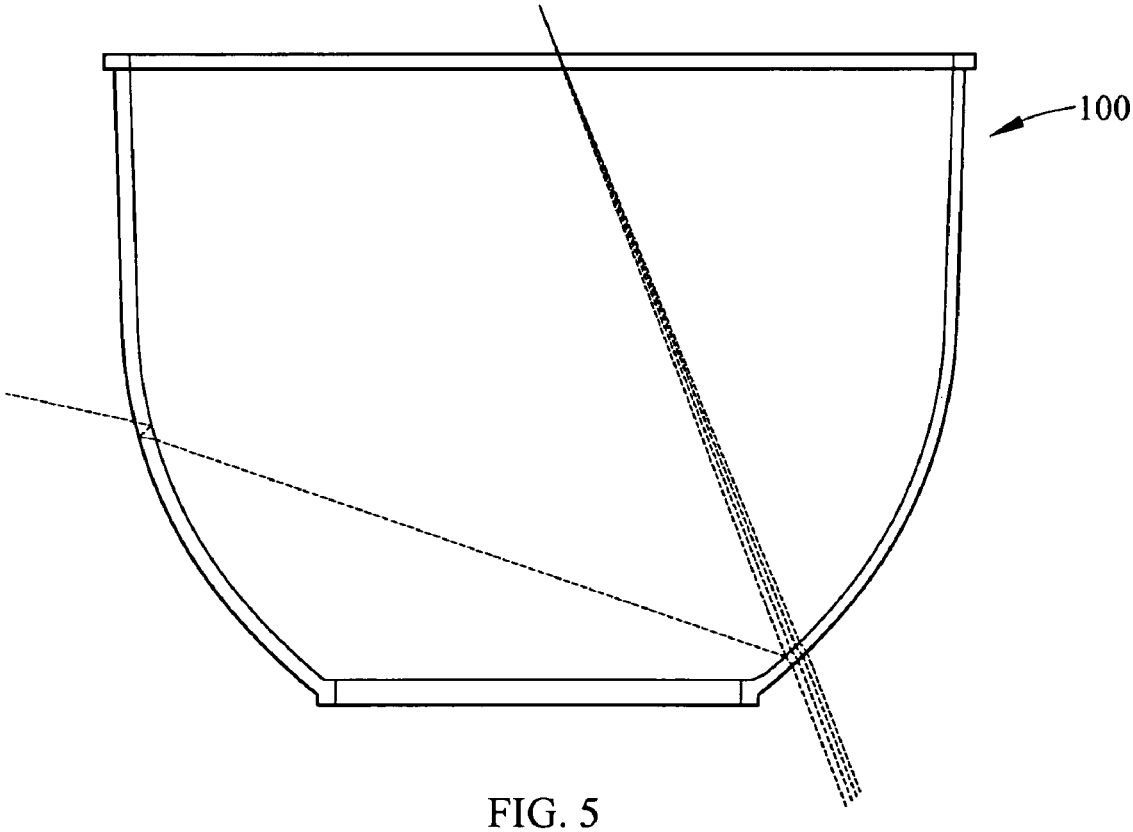
FIG. 5 is a side view of the effect a globe without prisms has on reflecting light.

As shown in FIGS. 4 and 5, the incidence angle of light ray from a light source impinging upon the globe surface which has no light scattering prismatic surfaces or features as in the present embodiments is such that the reflective light ray on the inside surfaces of the globe may be bounced or reflected at angles higher than 90 degrees. As indicated, for the globe 100 depicted in FIGS. 4 and 5 having a non-prismatic surface, implementation of a cutoff classification luminaire may be difficult even when providing extensive reflectors or shielding around the light source along a top portion of the globe as the light output being directed downward through the side curved surfaces of the luminaire globe would tend to be reflected upwards due to the characteristics of the globe material and the curvature of the globe itself.

In these types of designs, it may be desirable to implement a globe surface wherein exterior surfacing of the globe is kept smooth in order to provide a clean and neat appearance of the acorn style globe while also not creating shadowing or other noticeable visual irregularities in the globe. Thus, optical refraction as is known in the art through the use of prismatic surfaces on the exterior portion of the globe, tends to be undesirable as it changes the overall exterior appearance of the globe from the observer due to the use of extensive prismatic surfaces required in order to assure that proper reflective characteristics are maintained in an acorn style cutoff classification luminaire.

Turning to the lower up-light cutoff classification acorn style luminaire of the present embodiment depicted in FIG. 1 and the remaining figures, the luminaire is designed with a globe 20 having a lower curved section 28 having internal light transmitting prisms and an upper substantially vertical section 29. The globe may be topped with a globe top 40 which may be integral with the globe 20 or physically separated and hinged to the globe. The globe 20 may be mounted on top of a mounting pole 15 and capital and may have a mounting collar 17 and returning ring visible in FIG. 6 to affix the globe and the lamp support base 16 supporting the lamp 10 and lamp stem 18 to the capital. Typically these globes are sealed in an attempt to keep dirt and other particulate matter out of the optical assembly area internal to the globe. This may be accomplished in many ways, such as set forth in co-pending U.S. patent application Ser. No. 11/679,645 filed Feb. 27, 2007 titled "Sealed Acorn Luminaire", the entirety of which is incorporated by reference. Other configurations may be implemented and are considered to be incorporated in the teachings hereof.

Mounted internally of the globe 20 is the reflector 30, reflector 30 in the present embodiment depicted with a reflector cone 33, a primary reflector 32 and a reflector collar 31, the reflector primarily enclosing the arc tube lamp 10 for downward reflection of the light emitted therefrom. As clearly seen in FIGS. 1 and 6, the lamp 10 is substantially surrounded by the reflector elements and the lowest edge of the collar 31 extends below the mid-section of the lamp in this embodiment somewhat matching the location of the joinder point between the refractor globe vertical section 29 and the top 40. The globe 20 may additionally have a plurality of vertically extending prisms 25 extending substantially from the lower edge of the globe upwards towards the vertical section 29 of the globe, the vertical prisms 25 working in conjunction with the reflector 30 to properly provide optical characteristics for creating a cutoff classification acorn style luminaire while attempting to maintain the exterior of the globe free from such external prisms and textures which may refract or reflect light above 90 degrees.

The low up-light cutoff classification acorn style luminaire presently described and claimed provides a cutoff classification luminaire with an internal reflector which internally positions prisms controlling the luminaire optical output. The embodiment presently described further prevents potential scattering of the light output which may occur through the use of structures positioned on the exterior of the globe while also providing a clean appearance of the exterior of the globe while still maintaining cut-off classification.

Figure 6:
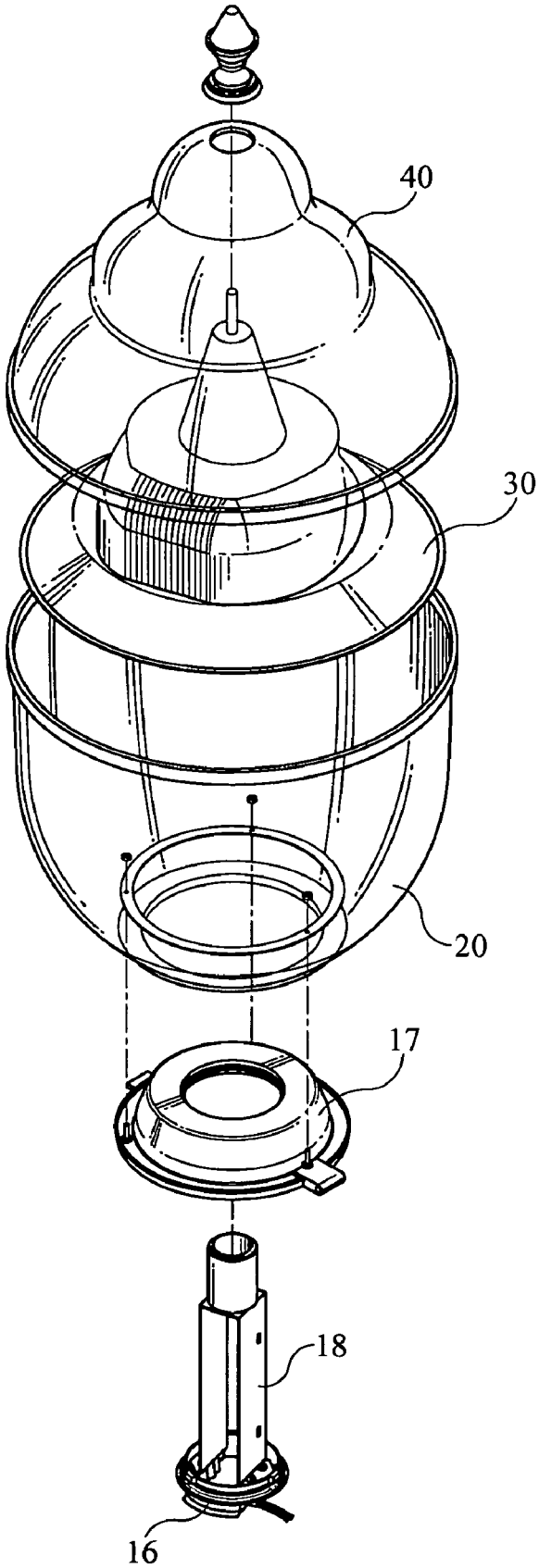
FIG. 6 is an exploded view of the fixture of FIG. 1 detailing the assembly and connection points between the globe and the mounting collar.

Turning to the particular design of the present embodiment shown in FIG. 1 and FIG. 6, the reflector 30 substantially encloses the lamp 10 and is affixed to the globe through the use of various known brackets, support mechanisms or devices. The reflector 30 may be affixed and held in place in between the top 40 and the globe 20 or may be suspended directly from the finial mounted to the top of the globe top 40 as is shown in FIG. 6.

Figure 1B:
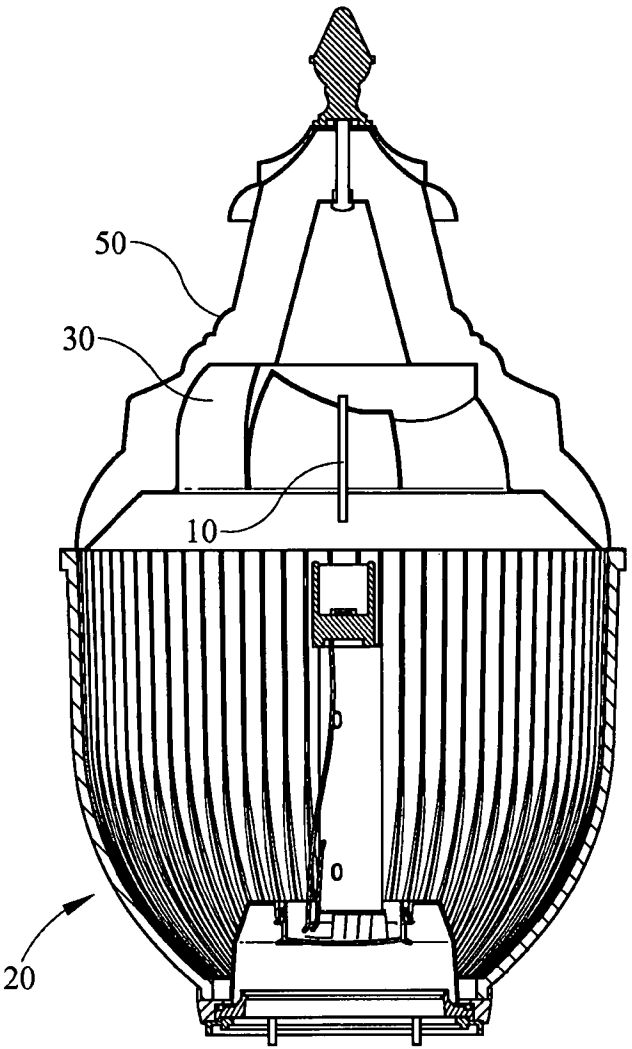
FIG. 1*b* is a partial side-sectional view of the cutoff acorn style luminaire of the present invention.
Figure 1A:
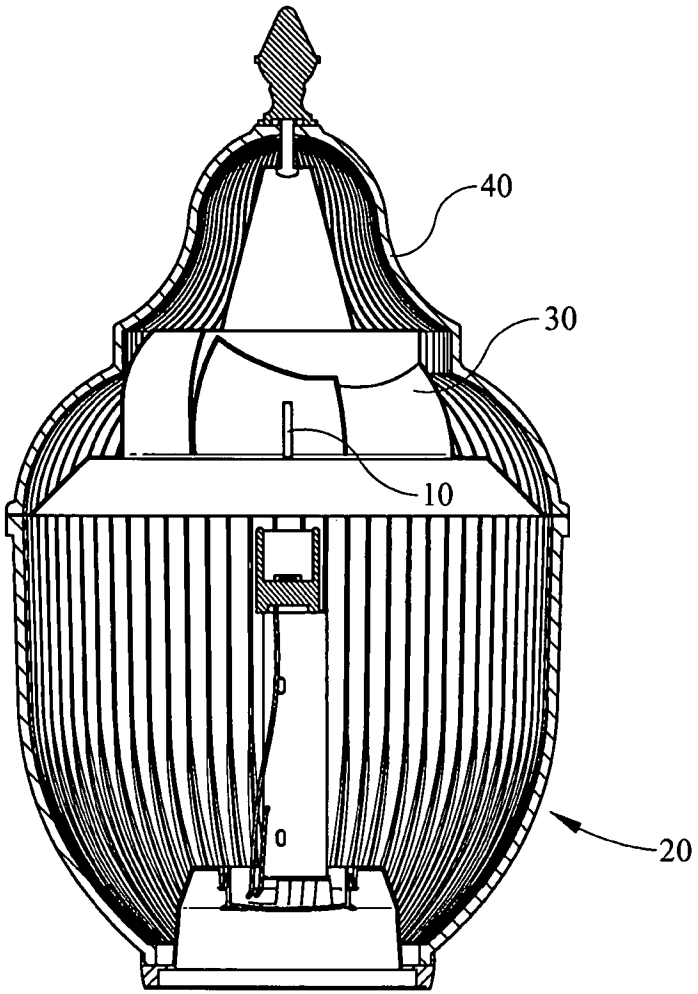
FIG. 1*a* is a side view of a cutoff acorn style luminaire of the present invention.
Figure 2:
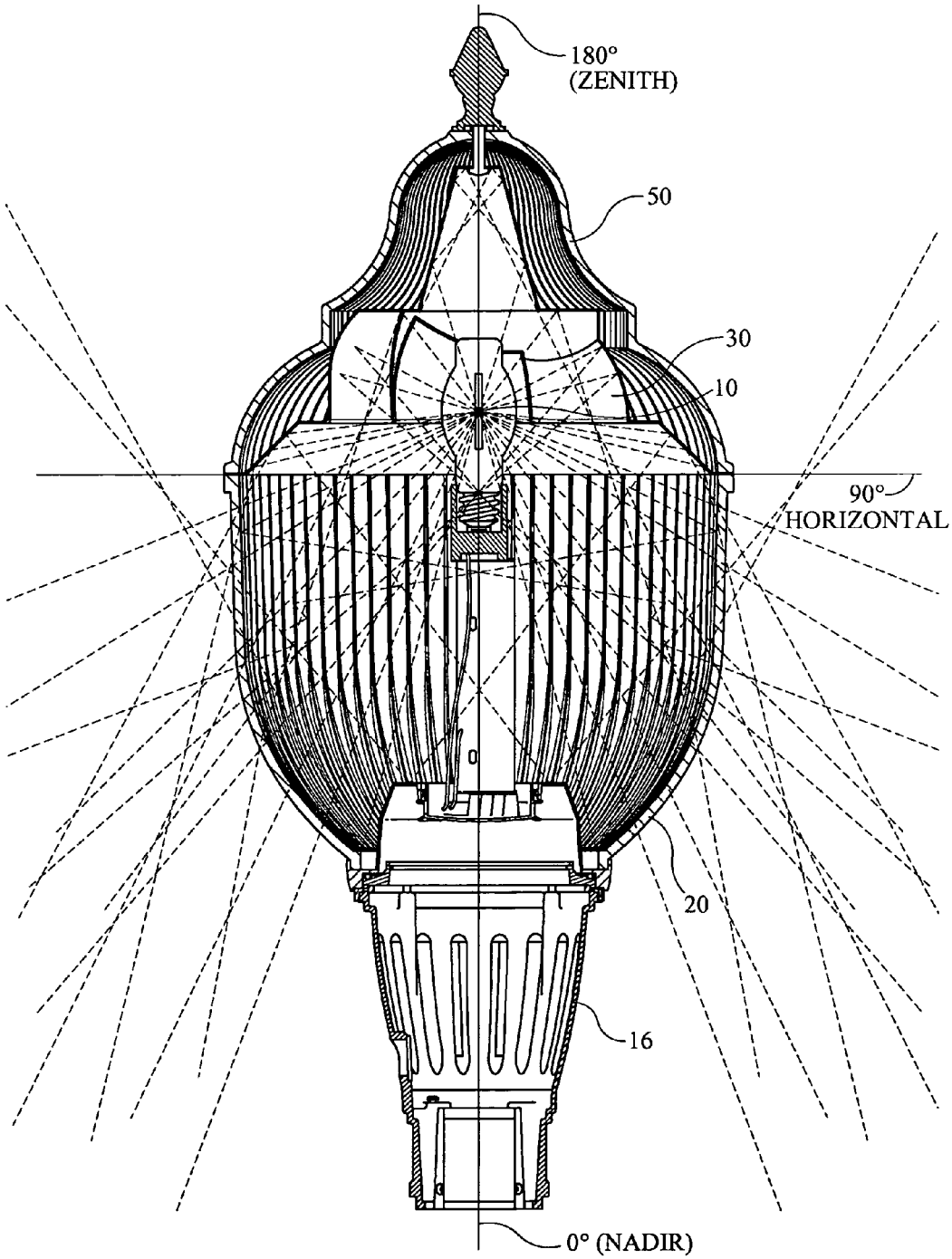
FIG. 2 is a ray tracing of the cutoff style acorn luminaire of the present invention.

The reflector 30 depicted substantially encloses the lamp 10 in order to provide high downward reflectance of the light emitted from the lamp 10 as is shown in FIG. 2 such that a substantial majority of light emitted and reflected exits from the globe in the area defined by the substantially vertical section 29 and the curved section 28. As can be understood, light must be emitted from the globe in the present design in these areas defined by the substantially vertical section 29 in the curved section 28 as the base of the globe will not emit light due to the positioning of the mounting collar 17 and mounting pole or capital 15. Further, the reflector 30 as shown encloses the arc tube and may be made of a highly reflective aluminum alloy that is chemically brightened and anodized which chemically or electrolytically coats the reflector material with a film or the like. The reflector 30 substantially encloses the lamp arc tube 10 in order to shield all the direct contributions of light source being emitted at angles above 90 degrees from nadir. As can be seen from FIG. 6 and FIG. 1, the reflector has three sections, the reflector cone 33, the primary reflector 32 and the reflector collar 31 which redirects and reflects the light emitted from the lamp 10 downward through the translucent portions of the globe 20. The reflector 30 is substantially enclosed within the globe top 40 which may be a semi-prismatic or clear globe top as shown in FIG. 1A and FIG. 6 or which may be a solid non-translucent hood such as is shown in FIG. 1*b*, depending upon the optical characteristics of the luminaire desired. In either case, whether use of a semi-prismatic glass or acrylic globe top or a non-translucent globe hood, the cutoff characteristics of the acorn style luminaire presently described remains intact.

Figure 3A:
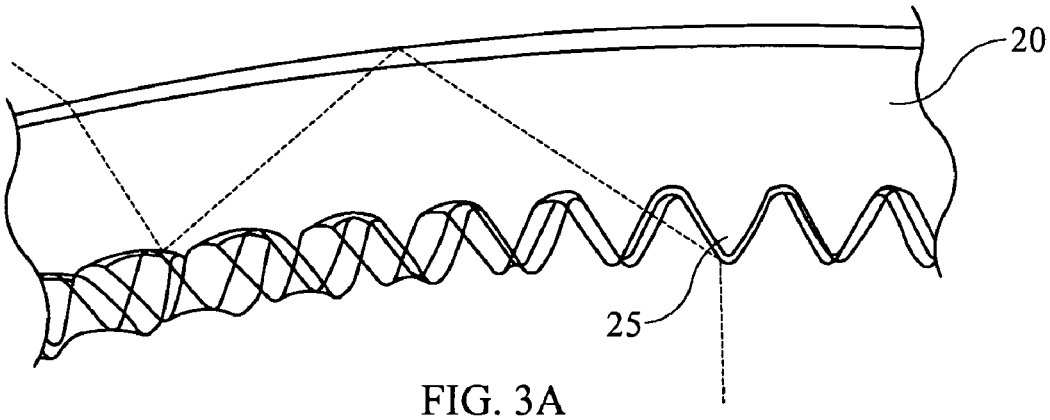
FIG. 3*a* is a top view of the prismatic features of the globe for use in the cutoff acorn style luminaire of the present invention.
Figure 3B:
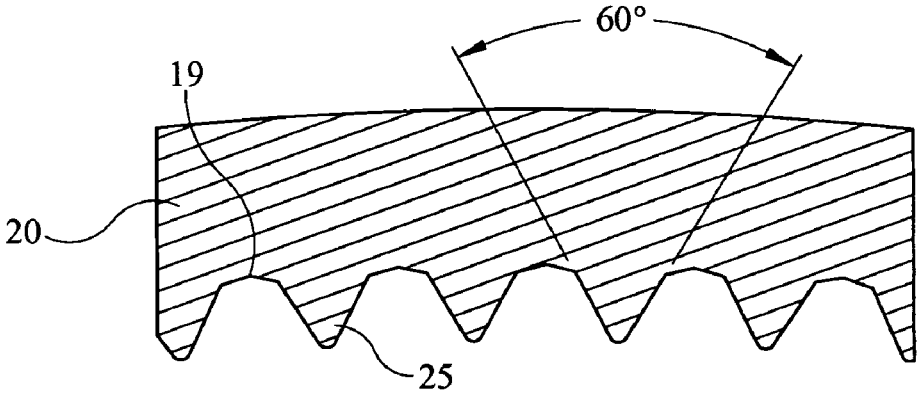
FIG. 3*b* is a close-up top view of the light transmission prisms utilized in the globe of the cutoff acorn style luminaire of the present invention.
Figure 3C:
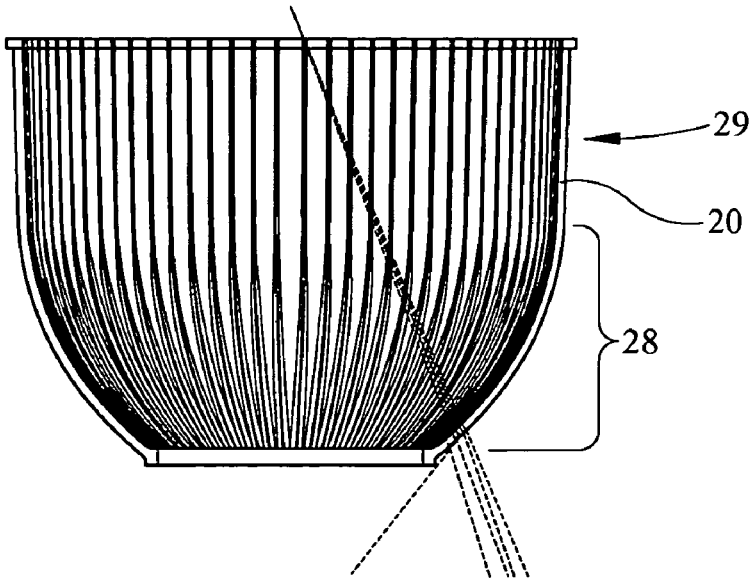
FIG. 3*c* is a side view showing the light transmission features utilizing the prismatic features for the globe in the cutoff acorn style luminaire of the present invention.

In combination with the reflector shield described herein, the globe 20 may be provided with a plurality of substantially vertically extending light transmitting prisms 25 formed on the interior curved surface of the globe 20 as shown in FIG. 3*c*. The globe 20 has a lower edge 21 which forms the aperture through which the mounting collar 17 extends. This lower edge of the globe 21 also form the starting point of the substantially vertical extending prisms 25 which extend upward through the curved section 28 of the globe towards the substantially vertical section 29. These vertically extending prisms 25 are shown as extending upward from the lower edge 21 through the curved section 28 of the globe 20. The semi-prismatic globe 20 utilizes these light transmission prisms 25 in order to minimize the reflected light and to redirect this light by reflecting light below 90 degrees instead of above 90 degrees. Thus, by placing the substantially vertically extending prisms 25 on the curved sections, light reflection above 90 degrees as shown in FIG. 5 is significantly reduced and adequate cutoff classification can be maintained. Further, the implementation of the prisms 25 on the interior of the globe 20 allows the globe to be smooth on the exterior without any further prismatic formation or other structure which may contribute to light above 90 degrees from horizontal. Thus, the globe 20 may be exempt from prisms and other textures on the exterior surface thereby eliminating chances for light rays being redirected upwards.

Turning to FIGS. 3*a*, 3*b* and 3*c*, it is apparent that the vertical prisms 25 formed on the globe interior surface are designed to have an effective transmitting prism angle of between 90 and 60 degrees and more preferably about 60 degrees. The exterior surface of the globe is designed such that it is preferably a smooth exterior surface, the globe being made of acrylic, polycarbonite, prismatic acrylic or polycarbonite glass and the like. Typical globes may also include utilization of all glass materials and the prisms shown in the figures are spaced such that light ray deflection is minimized at the crucial cutoff angles. As shown in FIGS. 3*a* and 3*b*, the horizontal cross-section at points along section 28 indicates that the effective angular displacement for the prism angles is preferably about 60 degrees with the concave areas 19 in between each individual prism 25 being slightly angular to provide faceted reflected surfaces. Multiple different angles and configurations may be implemented and utilized either for the prisms themselves 25 or the areas 19 located between the prisms with the intent to provide diffuse refraction of the light within cut-off criteria.

By implementing in combination the reflector 30 with the reflector cone 33, primary reflector 32 and reflector collar 31 in combination with the semi-prismatic cutoff classification acorn style globe 20 having the substantially vertically extending prisms 25 along the curved section thereof, reflection and refraction of light above 90 degrees to maintain cutoff specification can be exhibited. Utilizing the substantially vertical prisms on the interior surface of the globe and the reflectors which substantially enclose the lamp, in combination, provide the various cutoff style classifications required for an acorn style luminaire as taught and disclosed herein.

The foregoing description of structures and methods has been presented for purposes of illustration. It is not intended to be exhaustive or to limit the invention to the precise steps and/or forms disclosed, and obviously many modifications and variations are possible in light of the above teaching. It is understood that while certain forms of the low pressure forced air heater have been illustrated and described, it is not limited thereto except insofar as such limitations are included in the following claims and allowable functional equivalents thereof.

I claim:

1. A cutoff classification acorn style luminaire, comprising:

a globe defining an interior space, said globe having a top, said interior space of said globe having a reflector substantially enclosing a lamp, said lamp mounted on a lamp support, said lamp support affixed to a mounting collar, said mounting collar affixed to a lower edge of said globe;

said globe having a substantially vertical section and a curved section extending from a lower edge of said substantially vertical section to said lower edge of said globe, said curved section having on an interior surface a plurality of prisms, said prisms positioned on an interior curved surface of said globe so as to redirect and reflect light below about 90 degrees and allowing the exterior surface of said globe to be maintained prism free.

2. The acorn style luminaire of claim 1 wherein said prisms have an effective transmitting prism angle of between about 90 and about 60 degrees.

3. The acorn style luminaire of claim 1 wherein said effective transmitting prism angle is about 60 degrees.

4. The acorn style luminaire of claim 1 wherein said reflector has a reflector cone mounted atop a primary reflector area which is mounted atop a reflector collar, said primary reflector substantially enclosing said lamp in order to shield uplight from said lamp and create a cutoff classification in combination with said plurality of substantially vertical prisms, said reflector collar flaring outward to near said vertical section of said globe.

5. A low up-light cutoff classification acorn style luminaire, comprising:

a semi-prismatic globe enclosing a space and mounted on the top of a mounting pole, said semi-prismatic globe having an open aperture at a lower end, said open aperture at said lower end having a mounting collar mounted in between said globe and said mounting pole, said mounting collar supporting a lamp within said enclosed space;

said semi-prismatic globe having a plurality of light refracting prisms on an interior surface thereof and having a substantially smooth exterior;

said lamp positioned within said enclosed space and substantially surrounded by a reflector, said reflector enclosing said lamp in order to shield all the direct light contributions from said lamp being emitted at angles above 90 degrees from nadir;

wherein said plurality of light refracting prisms extend from said lower edge of said globe upward along a curved section of said globe towards a substantially vertical section of said globe.

6. The acorn style luminaire of claim 5 wherein said reflector includes a reflector cone, a primary reflector and a reflector collar below said primary reflector, said reflector collar extending downward to a point below a mid-section of said lamp and to a joinder of said reflector collar and a glove top.

7. The acorn style luminaire of claim 5 wherein said prisms have effective transmitting angles of between 40 and 80 degrees.

8. The acorn style luminaire of claim 5 wherein said prisms have an effective transmitting prism angle of about 60 degrees.

9. A low up-light cutoff acorn style luminaire, comprising:

a combined globe and globe top defining an interior space, a reflector retained within said interior space and substantially enclosing and surrounding a lamp, said lamp having a center point, said center point of said lamp position within said reflector, said reflector having a supporting bracket for supporting said reflector within said globe and globe top;

wherein said reflector encloses said lamp and shields all direct contributions of light emitted by said lamp at angles above 90 degrees from nadir;

said globe defining said acorn style luminaire globe having a substantially vertical section and a curved section, wherein said curved section has a plurality of translucent prisms interspaced on an interior wall, said globe being a semi-prismatic globe and said plurality of prisms positioned in order to minimize the reflected light from said lamp and to redirect said reflected light by reflecting it below 90 degrees from nadir;

said curved section of said globe mounted to a mounting collar for mounting of said globe onto a mounting pole, said lamp mounted within said globe and interior of said reflector by a lamp support mechanism in order to properly position said lamp within said reflector, said reflector position substantially within said globe top.

10. A low up-light cutoff semi-prismatic acorn style luminaire, comprising:

a semi-prismatic globe defining an interior space, a reflector retained within said interior space and substantially enclosing and surrounding a lamp, said lamp having a center point, said center point of said lamp position within said reflector, said reflector having a supporting bracket for supporting said reflector within said globe, wherein said reflector encloses said lamp and shields all direct contributions of light emitted by said lamp at angles above 90 degrees from nadir, said globe free from prismatic structures on an exterior surface;

said globe having a substantially vertical section and a curved section, wherein said curved section has a plurality of substantially vertically extending prisms interspaced on an interior wall, said plurality of prisms positioned in order to minimize the reflected light from said lamp and to redirect said reflected light by reflecting it below 90 degrees from nadir;

said curved section of said globe mounted to a mounting collar for mounting of said globe onto a mounting pole, said lamp mounted within said globe and interior of said reflector by a lamp support mechanism in order to properly position said lamp within said reflector.

11. A sealed acorn luminaire, comprising:

a globe permanently seated and sealed on a mounting collar with a seal interposed between said globe and said mounting collar;

said mounting collar having a removable lamp support base affixed to a lamp for supporting said lamp within said globe;

electrical wiring entering through said lamp support base, said electrical wiring in electrical contact with said lamp;

a reflector retained within said globe and surrounding a lamp, said lamp having a center point, said center point of said lamp positioned within said reflector, said reflector supported within said globe, wherein said reflector encloses said lamp and shields all direct contributions of light emitted by said lamp at angles above 90 degrees from nadir, said globe free from prismatic structures on an exterior surface;

said globe having a substantially vertical section and a curved section, wherein said curved section has a plurality of substantially vertically extending prisms interspaced on an interior wall, said plurality of prisms positioned in order to minimize the reflected light from said lamp and to redirect said reflected light by reflecting it below 90 degrees from nadir.

12. The luminaire of claim 11 wherein said reflector includes a reflector cone mounted atop a primary reflector which substantially surrounds said lamp, and a reflector collar flaring outward to near said globe vertical section.

* * * * *